US011679432B2

(12) United States Patent
Savard

(10) Patent No.: US 11,679,432 B2
(45) Date of Patent: Jun. 20, 2023

(54) CLAMPABLE PIPE BENDER FOR RESTRICTED AREA

(71) Applicant: Sebastien Savard, Quebec (CA)

(72) Inventor: Sebastien Savard, Quebec (CA)

( * ) Notice: Subject to any disclaimer, the term of this patent is extended or adjusted under 35 U.S.C. 154(b) by 0 days.

(21) Appl. No.: 17/693,210

(22) Filed: Mar. 11, 2022

(65) Prior Publication Data

US 2023/0083191 A1 Mar. 16, 2023

(30) Foreign Application Priority Data

Mar. 13, 2021 (GB) ..... 2103508

(51) Int. Cl.
*B21D 7/02* (2006.01)
*B21D 7/024* (2006.01)

(52) U.S. Cl.
CPC ..... *B21D 7/024* (2013.01)

(58) Field of Classification Search
CPC ..... B21D 7/02; B21D 7/021; B21D 7/022; B21D 7/024; B21D 7/063
See application file for complete search history.

(56) References Cited

U.S. PATENT DOCUMENTS

| | | | | |
|---|---|---|---|---|
| 81,902 | A | 9/1868 | Heckart | |
| 828,338 | A | 8/1906 | Reynolds | |
| 1,762,230 | A | 6/1930 | Johnson | |
| 1,899,281 | A | 2/1933 | Lidseen | |
| 2,569,544 | A | 10/1951 | Tal | |
| 2,796,785 | A | 6/1957 | Philippe | |
| 3,147,792 | A | 9/1964 | Hautau | |
| 3,172,452 | A | 3/1965 | Bryant | |
| 3,487,676 | A | 1/1970 | Guilbert et al. | |
| 4,546,632 | A | 10/1985 | Van Den Kieboom | |
| 2006/0277968 | A1* | 12/2006 | Mirtz | B21D 7/021 72/459 |
| 2011/0100084 | A1* | 5/2011 | Rusch | B21D 7/14 72/319 |

* cited by examiner

*Primary Examiner* — Debra M Sullivan
(74) *Attorney, Agent, or Firm* — Christopher Pilling

(57) ABSTRACT

A clampable pipe bender is provided having a pivotable base plate coupled to a clamp. Atop the pivotable base plate is a pipe bending assembly with a pivotable holding clamp. The pivotable holding clamp is locked in place by way of a pull pin. The pipe bending assembly is comprised of at least one but preferably a plurality of channels into any of which a pipe can be inserted for bending purpose.

8 Claims, 5 Drawing Sheets

CLAMPABLE PIPE BENDER FOR RESTRICTED AREA

CROSS-REFERENCE TO RELATED APPLICATIONS

The present application claims priority to application number GB2103508.4, filed on Mar. 13, 2021, the disclosure of which is hereby incorporated in its entirety at least by reference.

BACKGROUND OF THE INVENTION

1. Field of the Invention

The present invention relates generally to pipe bending but more particularly to a clampable pipe bender for use on restricted areas and on a lifting platform.

2. Description of Related Art

The use of pipe benders has been known for years but as work practices change, so is the need for adapted tools which can operate the way people work currently. For example, it used to be that a worker would climb a ladder, take measurements, climb down the ladder or at the very least, call to his helper to give him the measurement so that the helper would bend the pipe appropriately and hand it over to his workmate at the top of the ladder for installation.

Currently, there are various forms of scissor lifts or nacelles that can easily move one or more workers at various heights and locations within a construction site. This makes it more convenient to bring along some tools so as to be more efficient. The problem with current pipe bending tools is that, as one bends the pipes, the long end of the pipe sweeps across a wide area, which conflicts with the rather limited area of a lifting platform or a nacelle. There are also fixed height obstacles such as building structures which can get in the way when the work platform is raised-up close to the ceiling. When workers want to do the pipe bending inside the nacelle by pushing the bender on the floor of the nacelle, they have to open the safety door so as to be able to clear the full length of the pipe to be bent. This makes the safety feature of the nacelle obsolete and cause the accidental fall of the worker. A second possible method with a traditional bender is by having the handle on the floor of the platform and the head upwards, which has the drawback of having the long end of the pipe conflicting with many obstacles such as the structure of the building. This requires for the worker to lower the platform for each bending. Also, when current benders are in the platform, they often hang off the railing and risk falling off. This is why there are usually two workers: One in the nacelle and one on the ground, which is of course much less efficient, adding to the construction cost. Consequently, a clampable pipe bender for use on restricted areas is provided.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present disclosure to provide for a clampable pipe bender for use on a lifting platform or restricted area.

In order to do so, a clampable pipe bender is provided, comprising: a clamp configured to removably attach to a post, a railing, or a guardrail; a pivotable base plate rotatably coupled to the clamp; a pipe bending assembly attached to the pivotable base plate, wherein the pipe bending assembly comprises a channel configured to receive a pipe for bending; and, a pivotable holding clamp coupled to the pipe bending assembly, wherein the pivotable holding clamp is configured to secure the pipe into the channel of the pipe bending assembly.

In one embodiment, the clamp is a C-clamp. In one embodiment, a locking handle is provided, wherein the locking handle is configured to prevent the pivotable base plate from rotating in both directions, such that rotation is limited to one direction. In one embodiment, a handle is provided configured to rotate the pivotable base plate. In one embodiment, the pipe bending assembly comprises a plurality of channels having varying diameters such that multiple diameter pipes are configured to be bent via the clampable pipe bender. In another embodiment, comprising a pipe straighter configured to straighten pipes is provided. In yet another embodiment, a deburring tip holder configured to receive a deburring tip for cleaning a cut end of a pipe is provided. In another embodiment, the pivotable holding clamp is locked in place by way of a shoulder pin.

In another aspect of the invention a method of bending a pipe in a restricted area is provided, comprising steps: (a) providing a clampable pipe bender comprising a clamp a pivotable base plate rotatably coupled to the clamp, a pipe bending assembly attached to the pivotable base plate, wherein the pipe bending assembly comprises a channel; and, a pivotable holding clamp coupled to the pipe bending assembly; (b) securing the clampable pipe bender to a post, a railing, or a guardrail via the clamp; (c) inserting the pipe into the channel; (d) securing the pipe into the channel via the pivotable holding clamp; (e) locking the pivotable base plate from rotation in one direction via a locking handle; (f) bending the pipe via the pipe bending assembly; (g) rotating the pivotable base plate by pulling a handle coupled to the pivotable base plate according to the space available for the bended pipe; (h) the sequence is repeated until the pipe has been given the required bend; and, (i) removing the bended pipe by unlocking the pivotable holding clamp.

The foregoing has outlined rather broadly the more pertinent and important features of the present disclosure so that the detailed description of the invention that follows may be better understood and so that the present contribution to the art can be more fully appreciated. Additional features of the invention will be described herein after which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a clampable pipe bender for use on a lifting platform or restricted area.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about", "generally", or "approximately" apply to all numeric values, whether or not explicitly indicated. These terms generally refer to a range of numbers that one of skill in the art would consider near the stated amount by about 0%, 5%, or 10%, including increments therein. In many instances these terms may include numbers that are rounded to the nearest significant figure.

Figure 1:
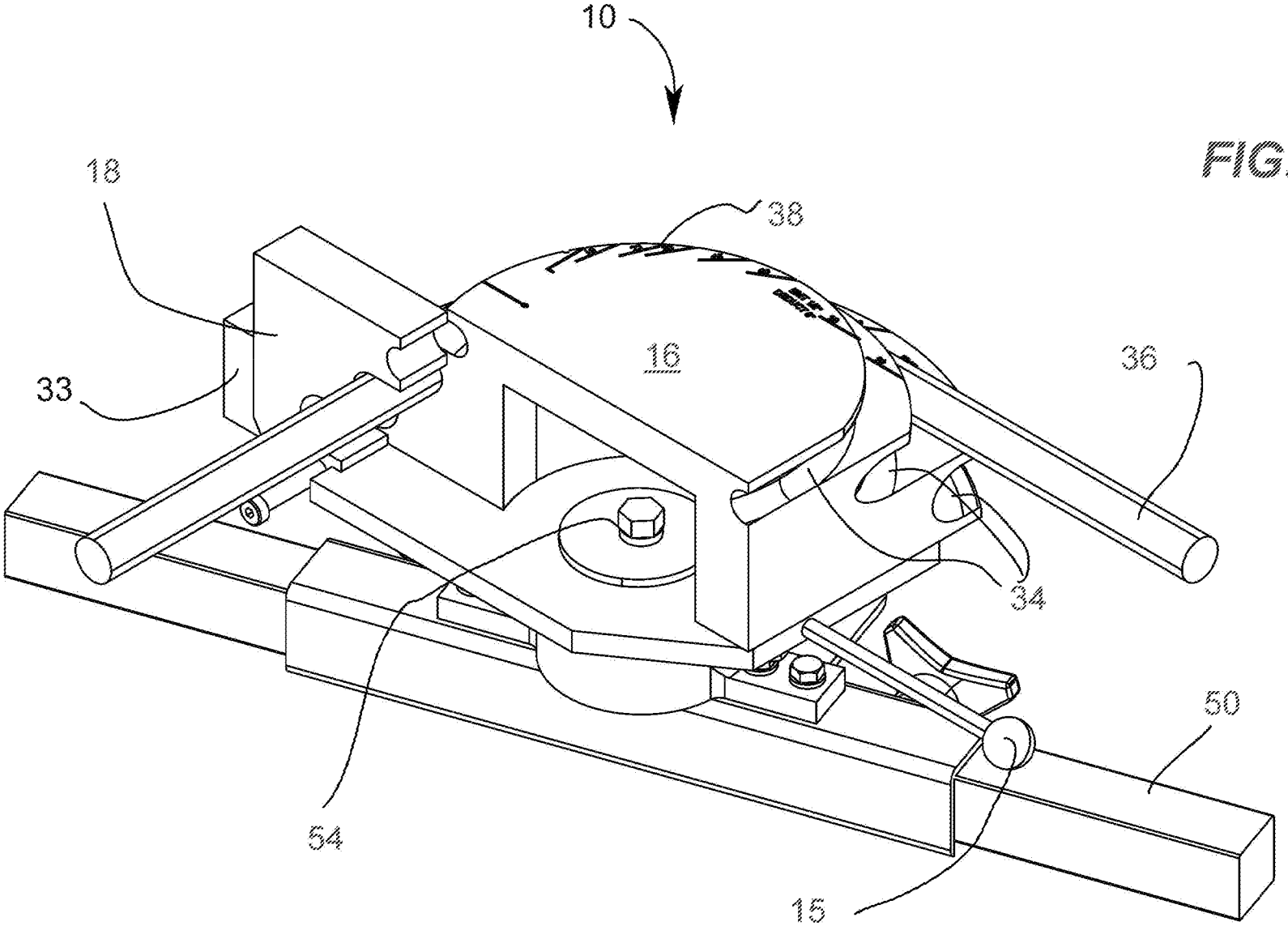
FIG. 1 is an isometric view of a clampable pipe bender with a bent pipe inserted therein according to an embodiment of the invention.
Figure 2:
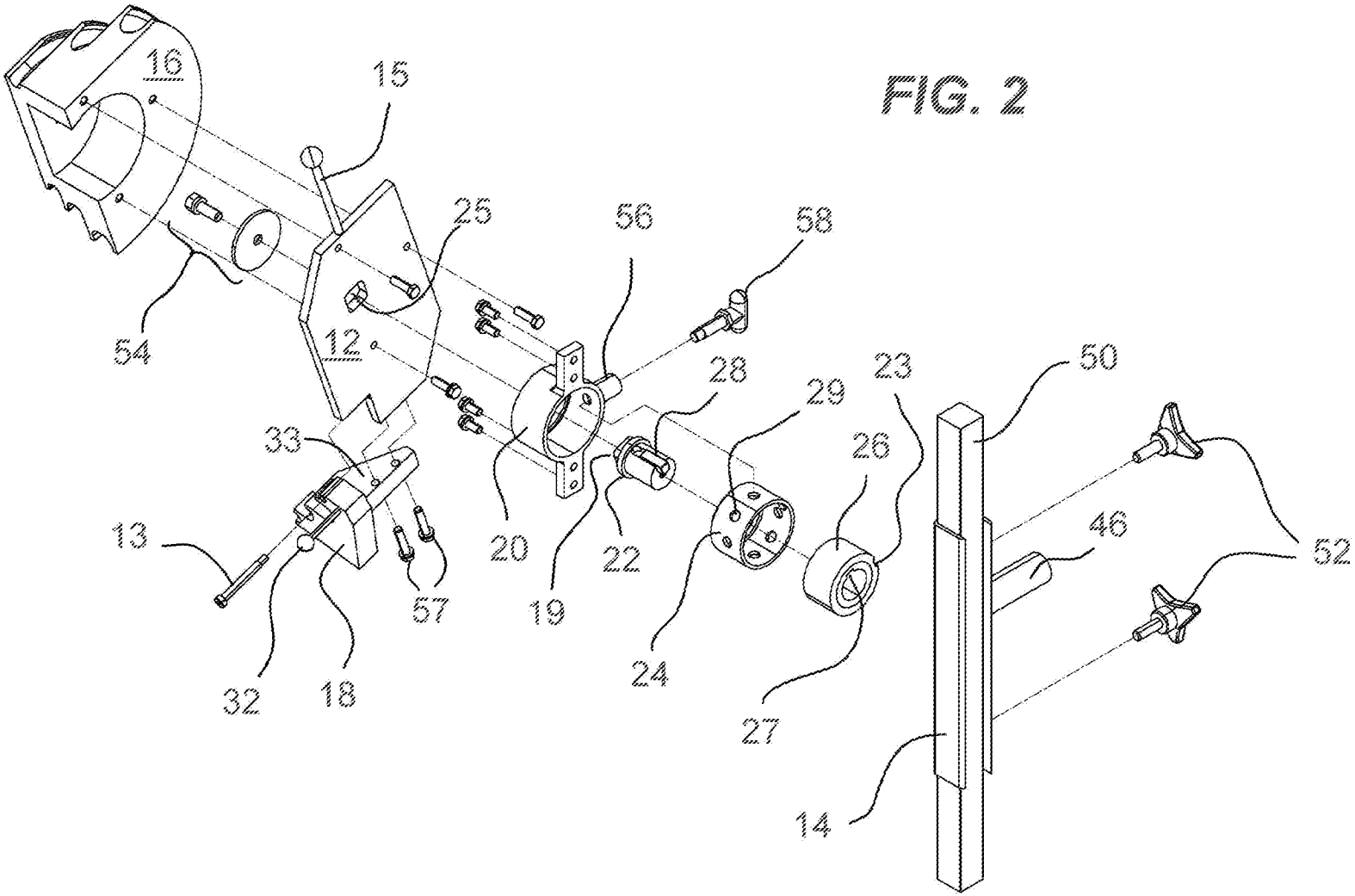
FIG. 2 is an exploded view of the clampable pipe bender according to an embodiment of the invention.
Figure 3:
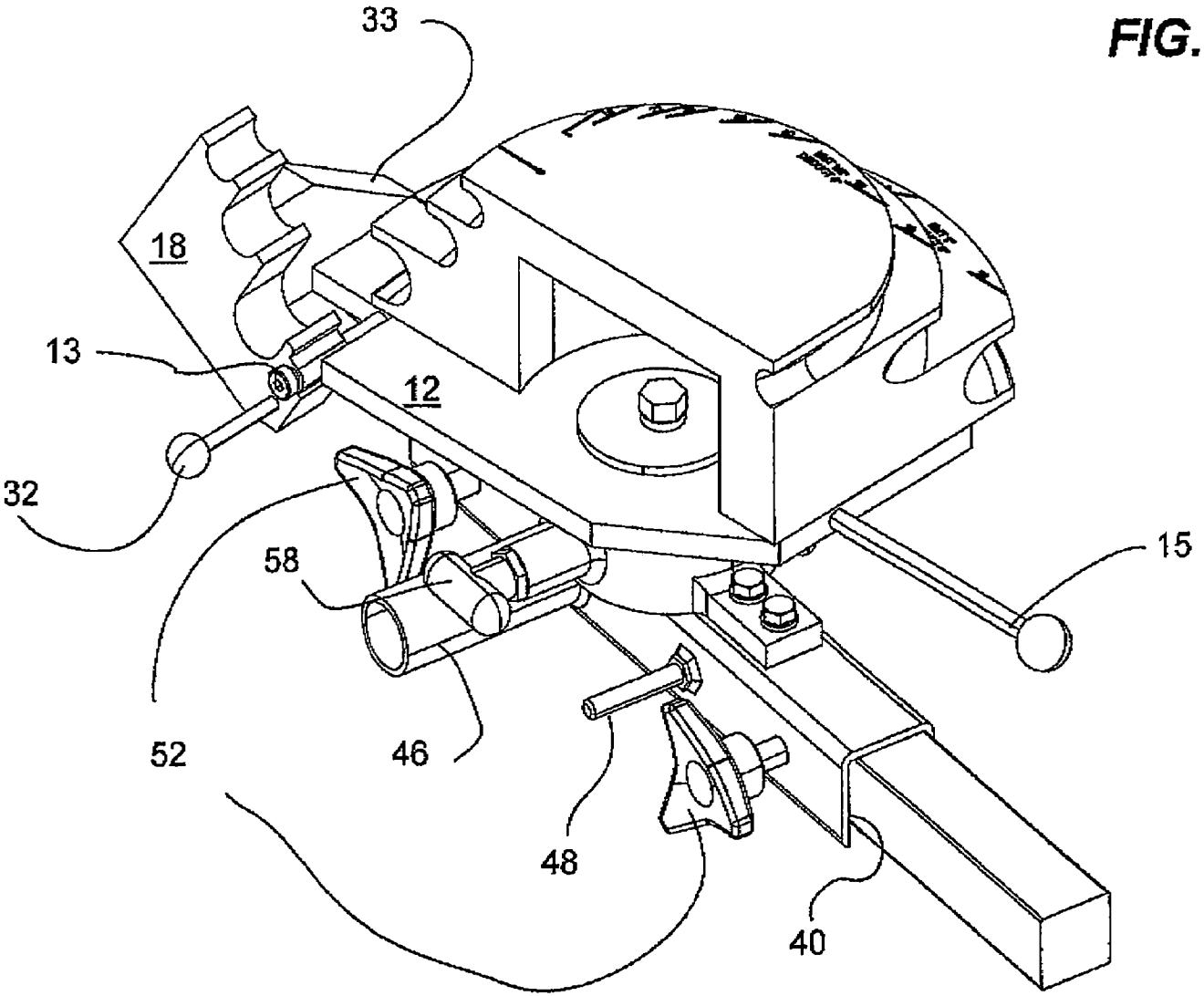
FIG. 3 is an isometric view of the clampable pipe bender with the pivotable holding clamp opened according to an embodiment of the invention.
Figure 4:
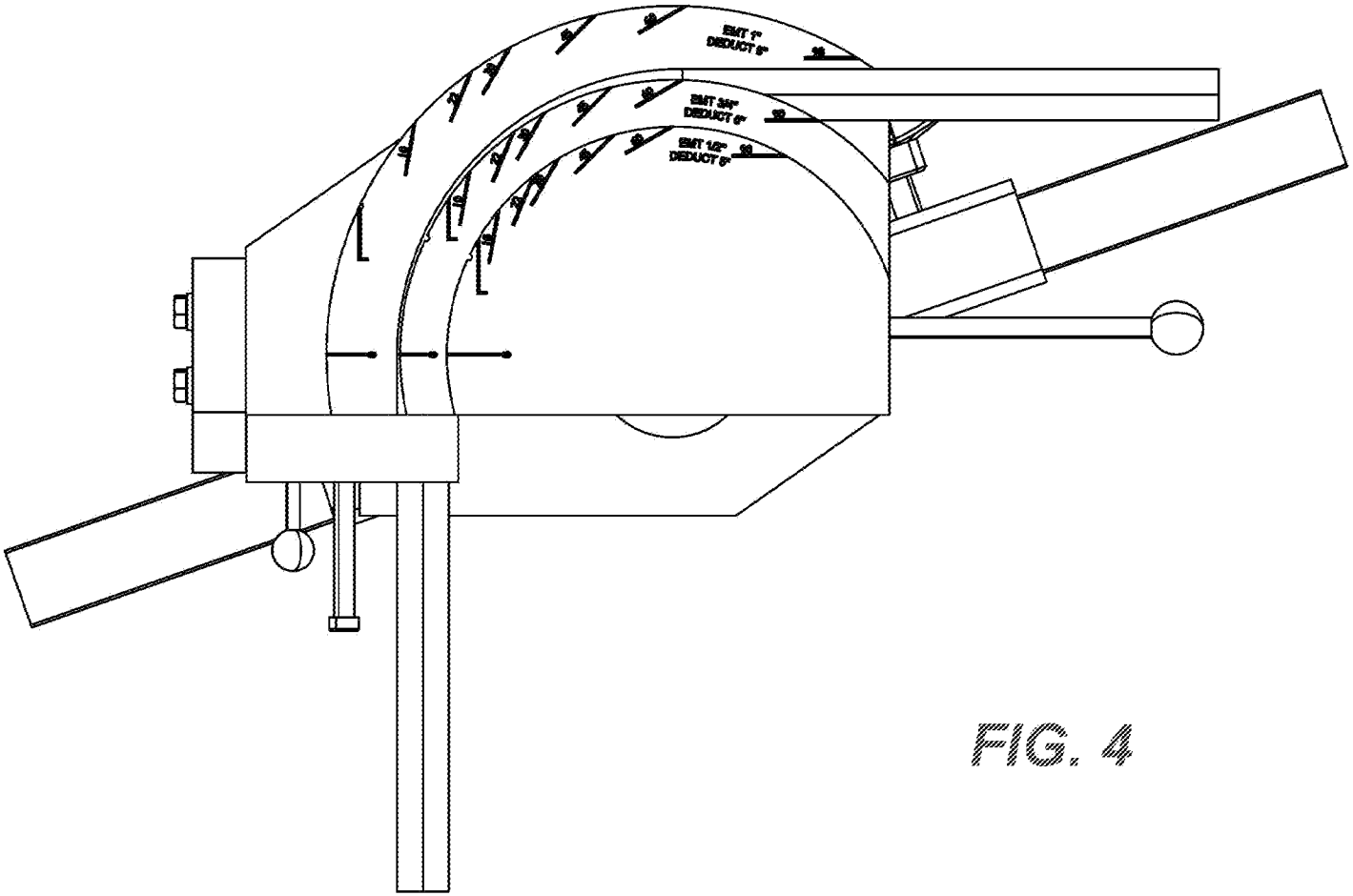
FIG. 4 is a top view of the clampable pipe bender with a bent pipe inserted therein according to an embodiment of the invention.
Figure 5:
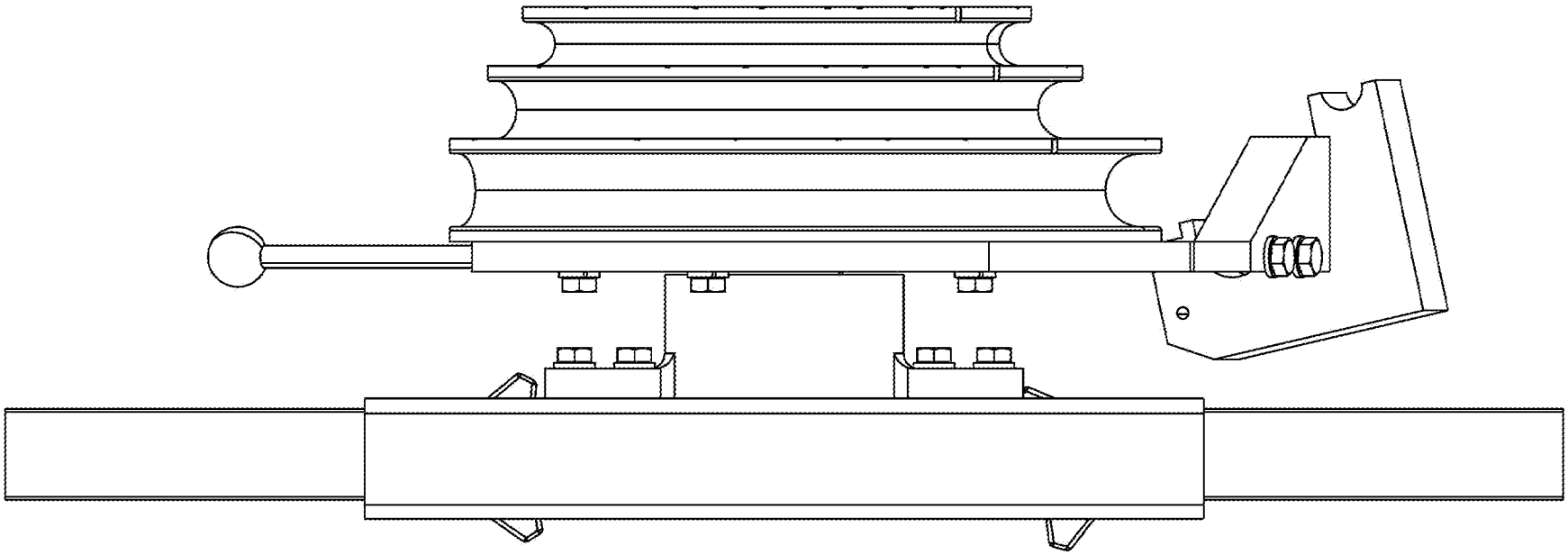
FIG. 5 is a side view of the clampable pipe bender with the pivotable holding clamp opened according to an embodiment of the invention.

Referring now to any of the accompanying FIGS. 1-5, a clampable pipe bender 10 is illustrated. In one embodiment, the clampable pipe bender is used for lifting platforms and restricted areas. For the purposes of this disclosure, guardrail 50 is illustrated, wherein the guardrail forms a portion of a platform (not shown). In one embodiment, the clampable pipe bender 10 is attached to the guardrail 50 via clamp 14, wherein the clamp is configured to be tightened by way of tightening screw knobs 52. In one embodiment, the clamp 14 is comprised of a "C" channel 40. As previously mentioned, the channel of clamp is configured and sized to fit on guardrail or railing 50 forming part of a lifting platform, scaffolding, or nacelle assembly (not shown).

In one embodiment, the clampable pipe bender 10 comprises a pivotable base plate 12 coupled to clamp 14. In one embodiment, a pipe bending assembly 16 is mounted on the top the pivotable base plate 12, wherein the pipe bending assembly includes a pivotable holding clamp 18 configured to hold one or more pipes during use. The pipe bending assembly will be discussed in further detail below.

In one embodiment, the pivotable holding clamp 18 is configured to pivot in and out of position so as to hold or release a pipe 36 during use. In one embodiment, the pivotable holding clamp 18 is mechanically attached to the pivotable base plate 12 by way of positioning pin 13. In some embodiments, the pivotable holding clamp 18 may include one or more channels such that one or more pipes of different diameters may be bent during use. More specifically, the pipe bending assembly 16 is comprised of a plurality of channels 34 into which the pipe 36 is inserted. The user may choose which channel of the plurality of channels 34 based on the diameter of the pipe, as each channel 34 has a different size so as to fit a pipe 36 of a given diameter. In some embodiments, there are also markings 38 to guide the user as to how much to bend to achieve the desired result. Advantageously, the bending assembly 16 eliminates the need for multiple pip benders configured to bend a different diameter of pipe. Although three channels 34 are provided, it is understood that more than three channels may be provided.

In one embodiment, the pivotable holding clamp 18 is configured to slide positioning pin 13, wherein the positioning pin 13 is fixed to the pivotable base plate 12. During use, pulling handle 32 moves the pivotable holding clamp 18 backwards so that it may clear block 33 and can thus pivot. In one embodiment, block 33 is fastened to the pivotable base plate 12 via fasteners 57.

In one embodiment, the pivotable base plate 12 comprises a handle 15 for facilitating its rotation during use. The rotation is enabled in one direction only so that the pipe bending can occur. This will be explained in further details below. In one embodiment, the rotation of the pivotable base is achieved by way of a bushing holder 20, a shaft 22, bushing 24, and a roller bearing 26, wherein the roller bearing 26 includes keyway channel 27 for receiving a key 28 forming part of shaft 22. In some embodiments, the key may be a separate component as well known in the art. In one embodiment, the roller bearing 26 is configured to be inserted into the bushing 24 and the shaft 22, which are housed in bushing holder 20. In one embodiment, the shaft 22 includes tip portion 19 protruding from the shaft 22, wherein the tip portion 19 is inserted into an insertion hole 25 positioned on the pivotable base plate 12. In one embodiment, the tip portion 19 is fixedly attached to the pivotable base plate 12 by way of a base plate mechanical fastener 54.

In one embodiment, the bushing holder 20 has an insertion port 56 for inserting lockable spring handle 58 which is further inserted into a hole 29 of a plurality of holes forming part of the bushing 24. When the locking handle is inserted in a selected hole 29, it lets the pivotable base plate 12 rotate only in one direction as the bushing 24 is fixedly attached to the groove 23 of the bearing 26 which only rotates in one direction. When the lockable spring handle 58 is removed from the holes 29, rotation becomes possible in both directions to facilitate maneuvers.

In some embodiments, a pipe straightener 46 is used for making corrections on pipes 36 that are not perfectly straight or have been over bent. In some embodiments, a deburring tip holder 48 can also be used for inserting a deburring tip for cleaning the cut ends of the pipe 36.

In one embodiment, the method of operating the clampable pipe bender is provided below, comprising steps: (a) inserting a pipe 36 in a given channel 34 on the pipe bending assembly 16; (b) locking the pipe 36 in place by rotating a holding clamp 18 in its locking position; (c) inserting the lockable spring handle 58 into a hole 29 so as to lock the base plate 12; (d) bending the pipe, via a user standing behind the pipe and pulling the pipe; (e) pulling the handle 15 to rotate the pivotable base plate according to the space available; (f) the sequence is repeated from step (d) until the pipe has been given the required bend; (g) removing the pipe by pulling on handle 32 which clears the holding clamp 18 from the block 33 so that it can pivot, wherein by pivoting, the holding clamp 18, unlocks the pipe 36 out of the channel 34; and, (h) optionally deburring the end of the pipe.

By doing this procedure, the operator can control the sweeping motion of the pipe 36 so that it does not interfere with any impediment and stays within a given area of the workspace which sits just above the lifting platform guardrail or nacelle so does not require any additional space. It should be mentioned, that in step (b) alternatively, the pipe 36 can slide in the channel 34 while the holding clamp 18 is already in its locking configuration. It should be mentioned, that in step (c) alternatively, the pipe 36 can slide in the channel 34 while the locking spring handle 58 is already in its locking configuration.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A clampable pipe bender comprising:

(a) a clamp configured to removably attach to a guardrail of a lifting platform having a limited space;

(b) a pivotable base plate rotatably coupled to the clamp;

(c) a pipe bending assembly attached to the pivotable base plate, wherein the pipe bending assembly comprises a channel configured to receive a pipe for bending, and;

(d) a pivotable holding clamp coupled to the pipe bending assembly, wherein the pivotable holding clamp is configured to secure the pipe into the channel of the pipe bending assembly;

(e) the pivotable base plate configured to enable the orientation and re-orientation of the pipe during bending to fit the limited space within the lifting platform; and, wherein the channel is on a parallel plane to the guardrail.

2. The clampable pipe bender of claim 1, the clamp is a C-clamp.

3. The clampable pipe bender of claim 1, further providing a locking handle, wherein the locking handle is configured to prevent the pivotable base plate from rotating in both directions, such that rotation is limited to one direction.

4. The clampable pipe bender of claim 1, further comprising a handle configured to rotate the pivotable base plate.

5. The clampable pipe bender of claim 1, wherein the pipe bending assembly comprises a plurality of channels having varying diameters such that multiple diameter pipes are configured to be bent via the clampable pipe bender.

6. The clampable pipe bender of claim 1, further comprising a pipe straightener comprised of a hollow cylinder with a free end and a fixed end attached to the clamp, wherein the pipe straightener enables a pipe that is not perfectly straight or has been over bent to be inserted into the free end of the hollow cylinder such that the pipe may be straightened and corrected.

7. The clampable pipe bender of claim 1, wherein the pivotable holding clamp is locked in place by way of a pull pin.

8. A method of bending a pipe in a restricted area, comprising steps:

(a) providing a clampable pipe bender comprising a clamp, a pivotable base plate rotatably coupled to the clamp, a pipe bending assembly attached to the pivotable base plate, wherein the pipe bending assembly comprises a channel; and, a pivotable holding clamp coupled to the pipe bending assembly;

(b) securing the clampable pipe bender to a guardrail of a lifting platform via the clamp, wherein the lifting platform having limited space;

(c) inserting the pipe into the channel, wherein the channel is on a parallel plane to the guardrail;

(d) securing the pipe into the channel via the pivotable holding clamp;

(e) locking the pivotable base plate from rotation in one direction via a locking handle;

(f) bending the pipe via the pipe bending assembly;

(g) rotating the pivotable base plate by pulling a handle coupled to the pivotable base plate according to the limited space available for the bended pipe; and, (h) removing the bended pipe by unlocking the pivotable holding clamp.

* * * * *